US007335110B2

(12) United States Patent
Tucker

(10) Patent No.: US 7,335,110 B2
(45) Date of Patent: Feb. 26, 2008

(54) BILLIARDS SHOT TRAINING DEVICE

(76) Inventor: Joseph Edward Tucker, 39 Cedar Pond Dr., Warwick, RI (US) 02886

( * ) Notice: Subject to any disclaimer, the term of this patent is extended or adjusted under 35 U.S.C. 154(b) by 27 days.

(21) Appl. No.: 11/276,251

(22) Filed: Feb. 21, 2006

(65) Prior Publication Data

US 2006/0189397 A1 Aug. 24, 2006

Related U.S. Application Data

(60) Provisional application No. 60/655,527, filed on Feb. 23, 2005.

(51) Int. Cl.
*A63D 15/00* (2006.01)

(52) U.S. Cl. ..... 473/2; 33/286

(58) Field of Classification Search ..... 473/2, 473/1, 17; 33/286

See application file for complete search history.

(56) References Cited

U.S. PATENT DOCUMENTS 3,389,911 A * 6/1968 Castiglione, Jr. ..... 473/2
3,411,779 A * 11/1968 McGowan ..... 473/2
3,711,091 A * 1/1973 Dixon ..... 473/2
4,268,033 A * 5/1981 Fontaine ..... 473/2

* cited by examiner

*Primary Examiner*—Mitra Aryanpour
(74) *Attorney, Agent, or Firm*—Barlow, Josephs & Holmes, Ltd.

(57) ABSTRACT

A shot training aid for a billiards cue for a billiards player to learn how to properly aim a shot in a game of billiards is disclosed. The shot training aid includes a main arm removably secured substantially at a tip of the billiards cue. The main arm has a left end portion and a right end portion. A left shot guide extends from the left end portion of the main arm and beyond the tip of the billiards cue. A right shot guide extends from the right end portion of the main arm and beyond the tip of the billiards cue. The left shot guide and the right shot guide are configured and arranged to accept a cue ball therebetween. When the billiards player properly aligns the billiards cue with the cue ball, neither the left shot guide nor the right shot guide contact the cue ball.

13 Claims, 3 Drawing Sheets

BILLIARDS SHOT TRAINING DEVICE

CROSS-REFERENCE TO RELATED APPLICATION

This application claims priority to earlier filed U.S. Provisional Application Ser. No. 60/655,527 filed Feb. 23, 2005, the contents of which are incorporated herein by reference.

BACKGROUND OF THE INVENTION

1. Field of the Invention

The present invention relates generally to training devices for billiards and more particularly to a training device to improve billiards player's shooting skills.

2. Background of the Related Art

Billiards is a very difficult game to learn and master. The task becomes even more difficult if a player is attempting to teach themselves the skills of the game. Many have tried to create new methods to help novice players. These methods generally include instructional books and videos. But these solutions lack the ability to physically show students what they are actually doing wrong so that they can correct their technique and continue to improve their play. Of course, novice billiards players may hire a professional billiards instructor, but they are expensive and not always available in all parts of the country. Therefore, there is a perceived need within the community for an inexpensive and novel solution to instructing the novice billiards player proper cue alignment and stroke technique.

Novice billiards players also typically have the bad habit of focusing on the cue ball rather than the object ball when practicing shots. Although instructional videos and books and professional instructors can warn the novice player of this bad habit, there is currently no device which can actually catch and correct this mistake as it is happening. Therefore, there is a perceived need within the community for a billiards shot training device that trains the novice billiards player to focus on the object ball.

Additionally, even more experienced players have difficulty applying proper left and right English to shots. Many players improperly shift their aim when attempting to add left or right English to their shots. Instructional videos and books, by their nature, lack the capacity to catch the player making this mistake and properly correct it. As noted earlier, a professional instructor can correct a student, but they are expensive and not always available. Therefore, there is also a perceived need in the community for a device to teach players of all skill levels proper application of right and left English to their shots.

SUMMARY OF THE INVENTION

The present invention provides an inexpensive and novel solution for the novice billiards player to learn how to improve his or her shot technique and to learn proper application of left and right English to his or her shots.

Briefly, the preferred embodiment of the present invention has a main arm with a clip for securably attaching the main arm to near the tip of a billiard cue. Extending from the ends of the main arm is a pair of shot guides. Preferably, the shot guides are removably secured to the main arm. The main arm is slightly longer than the width of a regulation billiard ball. The shot guides may be interchanged with a pair of English shot guides, which are angled. Extending from the main arm is also a targeting sight for to assist the billiards player to focus on an object ball.

Accordingly, among the objects of the present invention are:

the provision for a billiard shot training device to practice centering the cue on the billiard ball;

the provision for a billiards shot training device to practice keeping the cue centered on the ball during a stroke of the cue; the provision for a billiards shot training device to serve as a stroke trainer;

the provision for a billiards shot training device to practice applying proper left or right (as desired) English to a billiard shot; and the provision for a billiards shot training device that trains the billiards player to focus on the object ball; and the provision for a billiards shot training device that is inexpensive and easy to mass-produce.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE PREFERRED EMBODIMENTS

Figure 1:
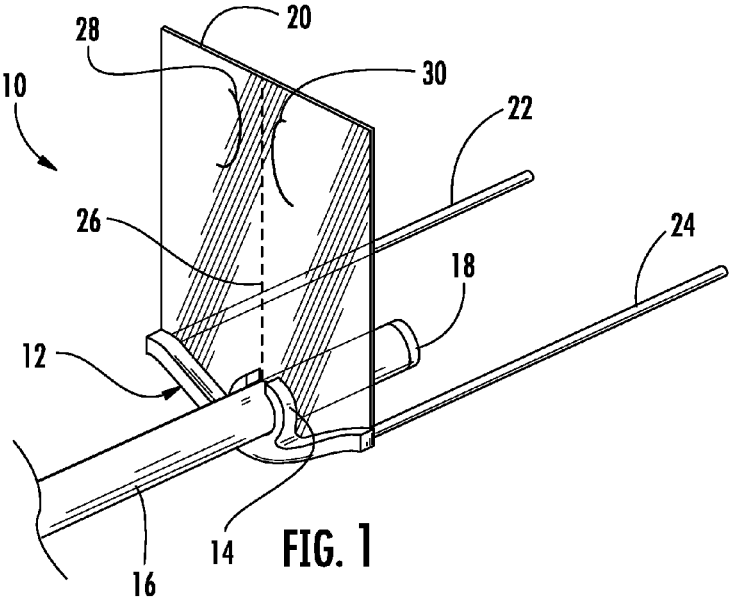
FIG. 1 is perspective view of the preferred embodiment of the present invention mounted on a billiards cue.
Figure 2:
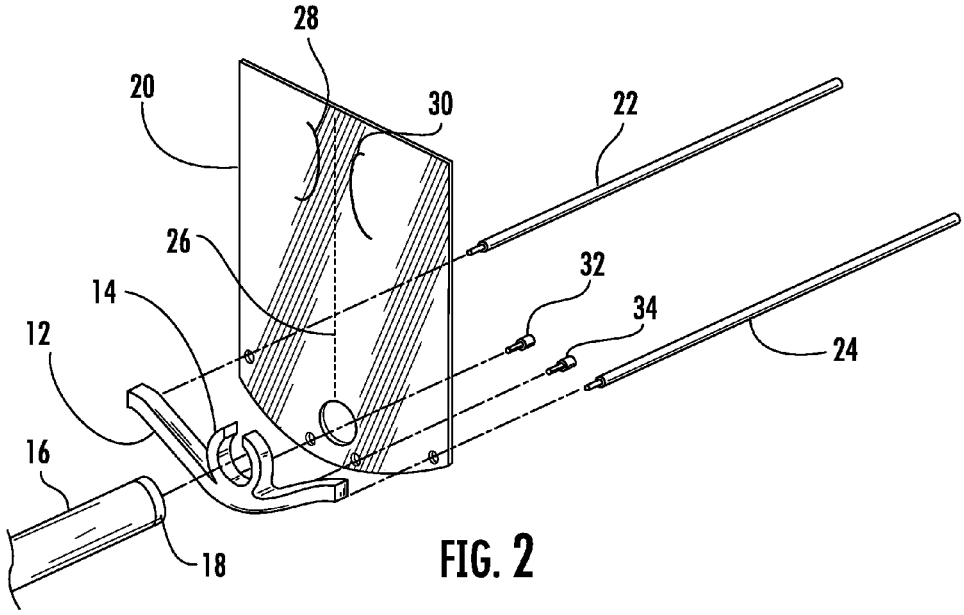
FIG. 2 is an exploded view of the preferred embodiment of the present invention.
Figure 3:
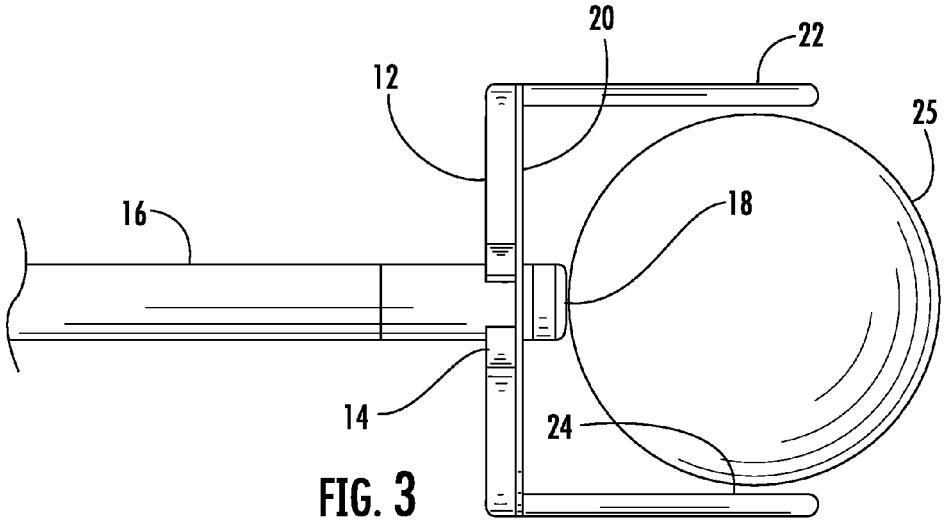
FIG. 3 is a plan view of the preferred embodiment of the present invention mounted on a billiards cue.

Referring to FIG. 1-3, the shot training device of the present invention is shown generally at 10. In a preferred embodiment, the shot training device 10 of the present invention has a main arm 12 with a central clip 14. The central clip 14 is removably, yet securely, attached to a billiards cue 16 near the tip 18 such that the main arm 12 extends substantially perpendicular to that of the billiards cue 16. The main arm 12 is slightly longer than the width of a regulation size billiards ball. Extending upwards from the main arm 12 is a targeting sight 20. Extending perpendicularly from the ends of the main arm 12 is a pair of shot guides 22, 24. As seen in FIG. 3, the shot guides 22, 24 are spaced sufficiently apart to allow a cue ball 25 to fit in between the shot guides 22, 24 without contacting either shot guide 22, 24.

Figure 5:
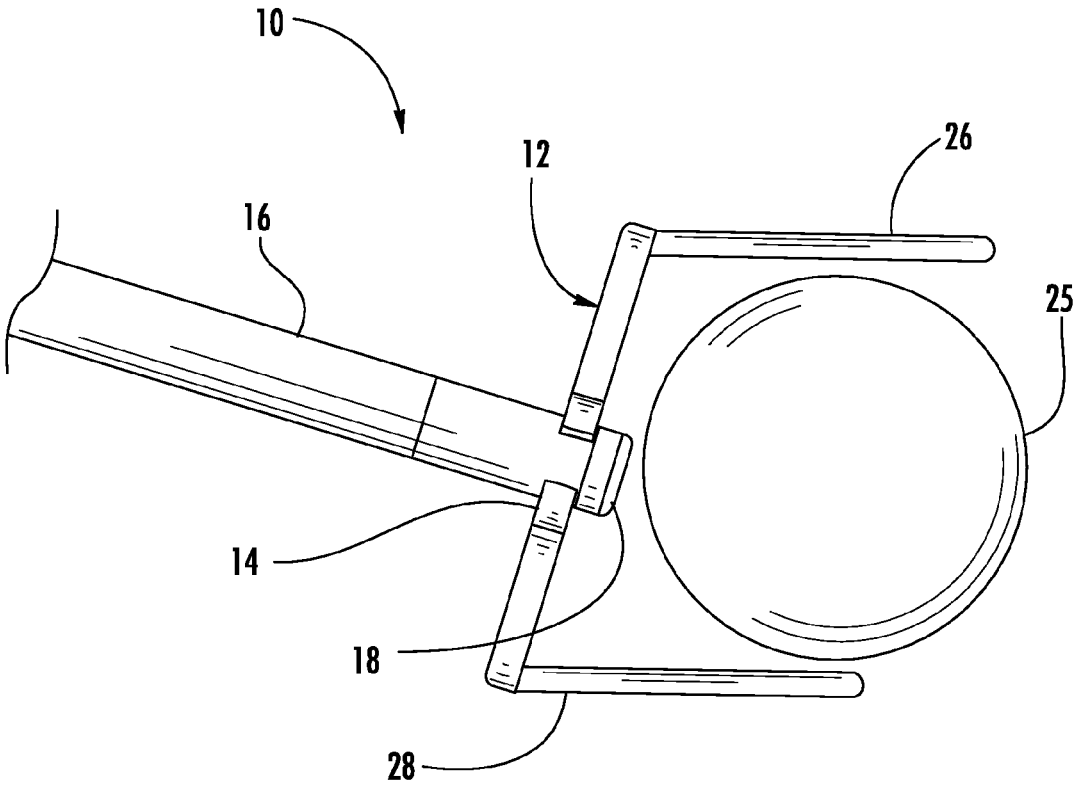
FIG. 5 is a plan view of an alternative embodiment of the present invention configured to provide a billiards player with training on applying English to shots.

The shot guides 22, 24 may also be removably attached to the main arm 12 so that they can be replaced with other types of shot guides 22, 24 as shown in FIG. 2. For instance, longer or shorter shot guides 22, 24 could be attached depending on whether the billiards player desires to practice aligning his or her shot or practice proper stroke technique. Additionally, as shown in FIG. 5, angled shot guides 26, 28 may be attached to provide a billiards player with training on applying English to shots.

Referring back now to FIGS. 1-3, preferably the shot guides 22, 24 are approximately three (3) inches long, but other variations are possible. The shot guides 22, 24 may be about as short as two (2) inches and about as long as six (6) inches. The longer shot guides 22, 24 provide the billiards player with the ability to practice proper stroke technique. The shorter shot guides 22, 24 provide the billiards player with the ability to practice their shot alignment technique. It is also desirable that the central clip 14 may be mounted to a billiards cue 16 at multiple locations along the cue's shaft in order to effectively vary the length of the shot guides 22, 24 that extend beyond the end of the cue's tip 18.

The targeting sight 20 is made of a transparent material, preferably plastic, and includes a centerline marking 26 and left and right sighting or indicator markings 28, 30. The indicator markings 28, 30 are half-circles and are spaced on either side of the centerline 26 with the convex portion of the half-circle nearest the centerline 26. As shown in FIG. 2, the targeting sight 20 is preferably held in place by the shot guides 22, 24 and two pins 32, 34 and may be removed if desired.

The billiards player uses the training device 10 by lining up for their shot as normal. Because the shot guides 22, 24 extend from the main arm 12 and beyond the tip 18 of the cue 16, the cue 16 is automatically centered horizontally on a cue ball 25. This provides the billiards player with practice as to how the arrangement of the cue 16 and billiard ball looks when properly aligned.

Figure 4:
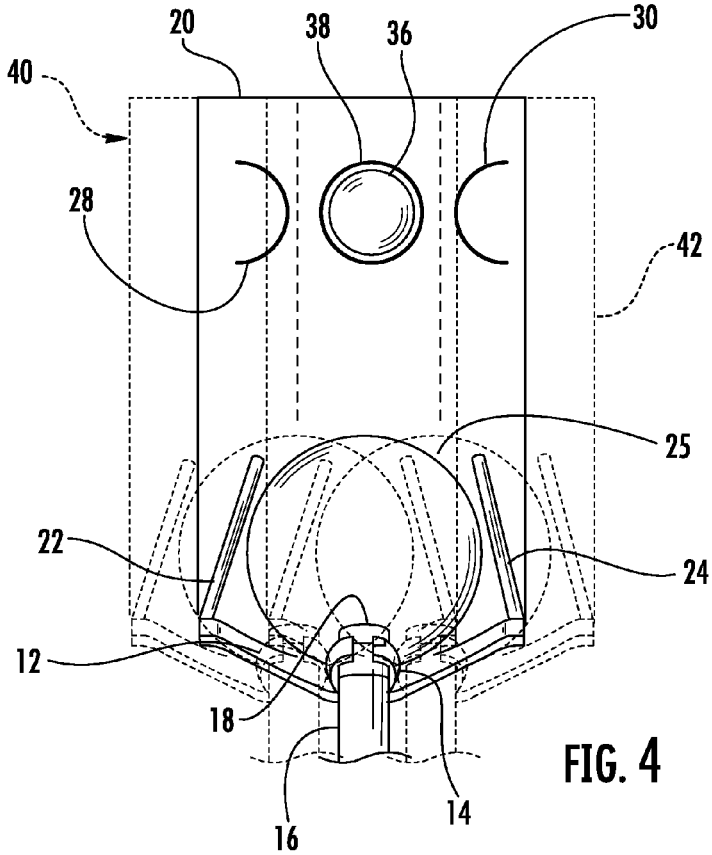
FIG. 4 is a top perspective view of the preferred embodiment of the present invention that illustrates the optical illusion created when the billiards player properly focuses on the object ball rather then the cue ball while aiming his or her shot, however, the arrangement of the parts is best seen in the perspective drawing shown in FIG. 1.

When the billiards player looks through the targeting sight 20 towards an object ball 36 as shown in FIG. 4, the two half-circle indicators 28, 30 appear to form a complete whole circle 38 around the object ball. This optical illusion occurs because of the stereoscopic effect of each eye focusing independently through the targeting sight at the object ball. This effect is illustrated in FIG. 4 by dashed lines 40 representing the left eye's view and dashed lines 42 representing the right eye's view. This feature of the invention trains the billiards player to look at the object ball 36 rather than the cue ball 25, which is a common mistake among novice billiards players.

Additionally, because the shot guides 22, 24 extend beyond the end of the tip 18 of the cue 16, the player may practice his or her stroke using the device as a "stroke trainer." If the player does not maintain the tip 18 of the cue horizontally centered relative the cue ball 25, the shot guides 22, 24 will strike the cue ball 25.

To practice applying left or right English to shots, the player may replace the shot guides with a pair of side (i.e. left or right) English shot guides 26, 28 as shown in FIG. 5. The side English shot guides 26, 28 preferably lean ten (10) degrees relative to the billiard cue 16, but different angles could be utilized depending on the amount of side English the player desires to practice applying. Most players have difficulty positioning the billiard cue 16 properly when trying to apply left or right English to a shot. The side English shot guides 26, 28 are designed such that when the player positions the cue 16 relative to the cue ball 25, the side English shot guides 26, 28 automatically cause the player to position the cue 16 with the correct angle relative to the cue ball 25. If the player does not position the cue 16 properly, the side English shot guides 26, 28 will strike the cue ball 25.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described, except insofar as limited by the appended claims.

What is claimed is:

1. A shot training aid for a billiards cue for a billiards player to learn how to properly aim a shot in a game of billiards, comprising:

a main arm configured and arranged to be removably secured substantially at a tip of the billiards cue, the main arm having a left end portion and a right end portion;

a left shot guide extending from the left end portion of the main arm, the left shot guide configured and arranged to extend beyond the tip of the billiards cue when the main arm is attached to the billiards cue;

a right shot guide extending from the right end portion of the main arm, the right shot guide configured and arranged to extend beyond the tip of the billiards cue when the main arm is attached to the billiards cue; and the left shot guide and the right shot guide configured and arranged to accept a cue ball therebetween;

whereby when the billiards player properly aligns the billiards cue with the cue ball, neither the left shot guide nor the right shot guide contact the cue ball.

2. The shot training aid of claim 1, wherein the left shot guide and the right shot guide are parallel to one another.

3. The shot training aid of claim 1, wherein the left shot guide and the right shot guide are perpendicular to the main arm.

4. The shot training aid of claim 1, wherein the left shot guide and the right shot guide extend at an angle from the main arm.

5. The shot training aid of claim 4, wherein the left shot guide and the right shot guide are angled ten degrees from perpendicular of the main arm.

6. The shot training aid of claim 1, wherein the left shot guide and the right shot guide are removably secured to the main arm.

7. The shot training aid of claim 1, further comprising:

a targeting sight extending upwardly and outwardly from the main arm, the targeting sight configured and arranged to cause the billiards player to focus on an object ball rather than the cue ball while aligning the billiards cue for a shot.

8. The shot training aid of claim 7, wherein the targeting sight is removably secured to the main arm.

9. The shot training aid of claim 7, wherein the targeting sight employs a stereoscopic visual effect to indicate to the billiards player that the billiards player is properly focusing his aim on the object ball rather than the cue ball.

10. The shot training aid of claim 9, wherein the targeting sight comprises:

a transparent body member, a left half of an indicator positioned right of center of the transparent body member, and a right half of an indicator positioned left of center of the transparent body member, whereby when the billiards player focuses on the object ball while looking through the targeting sight, an optical illusion is formed and the left half of an indicator and the right half of an indicator appear to join one another to form a complete indicator.

11. The shot training aid of claim 10, wherein the left half of an indicator is the left half of a circle and the right half of an indicator is the right half of a circle.

12. The shot training aid of claim 1, wherein the left shot guide and the right shot guide are from about 2 inches to about 6 inches long.

13. The shot training aid of claim 12, wherein the left shot guide and the right shot guide are about 3 inches long.

* * * * *